US011659334B2

(12) United States Patent
Ren et al.

(10) Patent No.: US 11,659,334 B2
(45) Date of Patent: May 23, 2023

(54) ACOUSTIC DEVICE

(71) Applicant: AAC Microtech (Changzhou) Co., Ltd., Changzhou (CN)

(72) Inventors: Zhang Ren, Shenzhen (CN); Zhiwei Zhong, Shenzhen (CN)

(73) Assignee: AAC Microtech (Changzhou) Co, , Ltd., Changzhou (CN)

( * ) Notice: Subject to any disclaimer, the term of this patent is extended or adjusted under 35 U.S.C. 154(b) by 27 days.

(21) Appl. No.: 17/541,281

(22) Filed: Dec. 3, 2021

(65) Prior Publication Data

US 2023/0031282 A1 Feb. 2, 2023

(30) Foreign Application Priority Data

Aug. 2, 2021 (CN) ..... 202121787783.4

(51) Int. Cl.

| | |
|---|---|
| ***H04R 9/06*** | (2006.01) |
| ***H04R 7/16*** | (2006.01) |
| ***H04R 9/04*** | (2006.01) |
| ***H04R 9/02*** | (2006.01) |

(52) U.S. Cl.

CPC ..... *H04R 9/06* (2013.01); *H04R 7/16* (2013.01); *H04R 9/025* (2013.01); *H04R 9/046* (2013.01); *H04R 2400/11* (2013.01)

(58) Field of Classification Search

CPC ..... H04R 7/20; H04R 25/00; H04R 31/00; H04R 1/1016; H04R 2231/003; H04R 2499/11; H04R 2307/204; H04R 1/021; H04R 1/30; H04R 1/2811; H04R 1/2803; H04R 3/00; H04R 1/06; H04R 1/1025; H02J 50/005; H02J 50/10; H02J 7/0042

See application file for complete search history.

(56) References Cited

U.S. PATENT DOCUMENTS

| | | | | |
|---|---|---|---|---|
| 2011/0123061 | A1* | 5/2011 | Kamimura | H04R 31/00 381/412 |
| 2013/0016874 | A1* | 1/2013 | Huang | H04R 9/043 381/433 |
| 2021/0274289 | A1* | 9/2021 | Wang | H04R 1/2834 |
| 2023/0029866 | A1* | 2/2023 | Ren | H04R 9/025 |

* cited by examiner

*Primary Examiner* — Alexander Krzystan
*Assistant Examiner* — Julie X Dang
(74) *Attorney, Agent, or Firm* — W&G Law Group

(57) ABSTRACT

The present invention provides an acoustic device including a frame, a magnetic circuit system, and a vibration system. The vibration system includes a diaphragm, a voice coil, and a support. The diaphragm includes a dome, a first suspension, and a second suspension. The diaphragm includes a first fixation portion, and the dome includes a dome body and a first dome extending wall bending and extending from the dome body, the first fixation portion connected to and wrapping the first dome extending wall.

10 Claims, 5 Drawing Sheets

II-II

II-II

ACOUSTIC DEVICE

FIELD OF THE PRESENT INVENTION

The present invention relates to electro-acoustic transducers, and more particularly, to an acoustic device used in electronic speaker box products.

DESCRIPTION OF RELATED ART

Whit the rapid development of wireless communication technologies, mobile phone and other consumer electronic products are widely used. The acoustic devices are also known as speakers or horns, and are often used in these products. Specifically, they are used in speaker boxes to convert electrical signals into sound for playback.

In related art, the acoustic device usually includes a frame, a magnetic circuit system having a magnetic gap, and a vibration system supported on the frame. The magnetic circuit system drives the vibration system to generate sounds. The vibration system usually includes a membrane fixed on the frame, a dome attached to the membrane, a voice coil located in the magnetic gap, and a support connecting the dome and the voice coil.

However, in acoustic device of the related art, the dome and the support are usually with a flat structure, and which resulting insufficient strength of the dome and the support, so that the frequency band of the acoustic device is narrow and the sound effect is not good.

Therefore, it is desired to provide a new acoustic device which can overcome the above problems.

SUMMARY

In view of the above, the embodiment of the present invention provides a new acoustic device. By the present invention, the acoustic device has a better performance.

The present invention provides an acoustic device including a frame, a magnetic circuit system having a magnetic gap, a vibration system supported on the frame. The vibration system comprises a diaphragm, a voice coil at least partially located in the magnetic gap and driving the diaphragm to generate sounds, and a support connecting with the diaphragm and the voice coil. The diaphragm comprises an annular dome, an annular first suspension, and an annular second suspension. The first suspension surrounds and spaces apart from the second suspension. The dome locates between and connects with the first and second suspension. The diaphragm further comprises a first fixation portion bending and extending from a side of the first suspension proximal to the second suspension. The dome comprises an annular dome body and a first dome extending wall bending and extending from the dome body along a direction toward the magnetic circuit system. The first fixation portion connects to and wraps the first dome extending wall.

As an improvement, the support comprises a support flat wall, a first support extending wall, and a second support extending wall, the support flat wall is attached to a surface of the dome body proximal to the voice coil, the first support extending wall bends and extends from a side of the support flat wall proximal to the first suspension along the direction toward the magnetic circuit system, the first support extending wall is arranged spaced apart from and opposite to the first dome extending wall, the second support extending wall extends from a side of the support flat wall proximal to the second suspension along the direction toward the voice coil and is fixed to the voice coil.

As an improvement, the first fixation portion comprises a first holding wall bending and extending from a side of the first suspension proximal to the second suspension, a first side wall bending and extending from a side of the first holding wall proximal to the first suspension along a vibration direction toward the magnetic circuit system, a first top wall bending and extending from the first side wall along the direction away from the first suspension, and a second side wall bending and extending from the first top wall along the vibration direction away from the magnetic circuit system, the first side wall, the first top wall, and the second side wall cooperatively enclose a first receiving slot for accommodating the first dome extending wall, an outer peripheral of the dome body is attached to a surface of the first holding wall proximal to the magnetic circuit system.

As an improvement, the first support extending wall is arranged spaced apart from the second side wall.

As an improvement, the first dome extending wall is formed by extending from the dome body along the vibration direction of the diaphragm, the first support extending wall is formed by extending from the side of the support flat wall proximal to the first suspension along the vibration direction.

As an improvement, the diaphragm further comprises a second fixation portion bending and extending from a side of the second suspension closed to the first suspension, the dome comprises a second dome extending wall bending and extending from a side of the dome body distal to the first dome extending wall to the direction toward the magnetic circuit system, the second fixation portion connects to and wraps the second dome extending wall.

As an improvement, the second fixation portion comprises a second holding wall and a third side wall bending and extending from a side of the second suspension closed to the first suspension, the second holding portion is arranged spaced apart from the third side wall and cooperatively encloses a second receiving slot with the third side wall, the second dome extending wall is received in the second receiving slot, an inner peripheral of the dome body is attached to the surface of the second holding wall proximal to the voice coil.

As an improvement, both of the first suspension and the second suspension are in arc-shaped structures, each of the first suspension and the second suspension has a recess direction, and the two recess directions are in opposite directions.

As an improvement, the recess direction of the first suspension is a direction proximal to the voice coil, and the recess direction of the second suspension is a direction distal to the voice coil.

As an improvement, the diaphragm further comprises a third fixation portion bending and extending from a side of the first suspension distal to the second suspension, the third fixation portion is mounted to an inner peripheral of the frame.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present invention. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of the present invention more apparent, the present invention is described in further detail together with the figures and the embodiment. It should be understood the specific embodiment described hereby is only to explain the disclosure, not intended to limit the disclosure.

Figure 1:
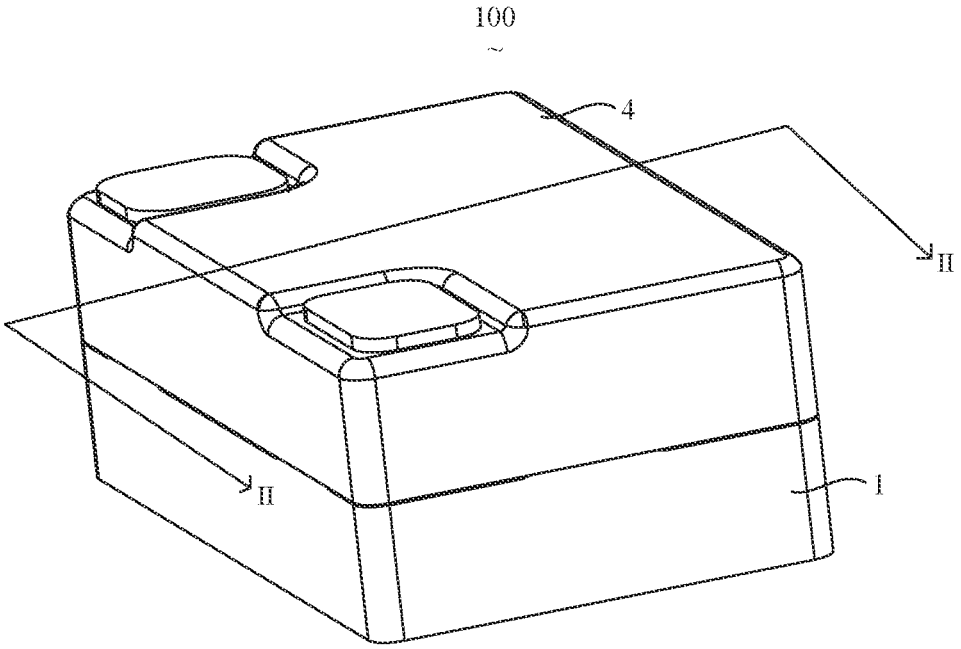
FIG. 1 is an illustrative isometric view of an acoustic device in accordance with one embodiment of the present invention.
Figure 2:
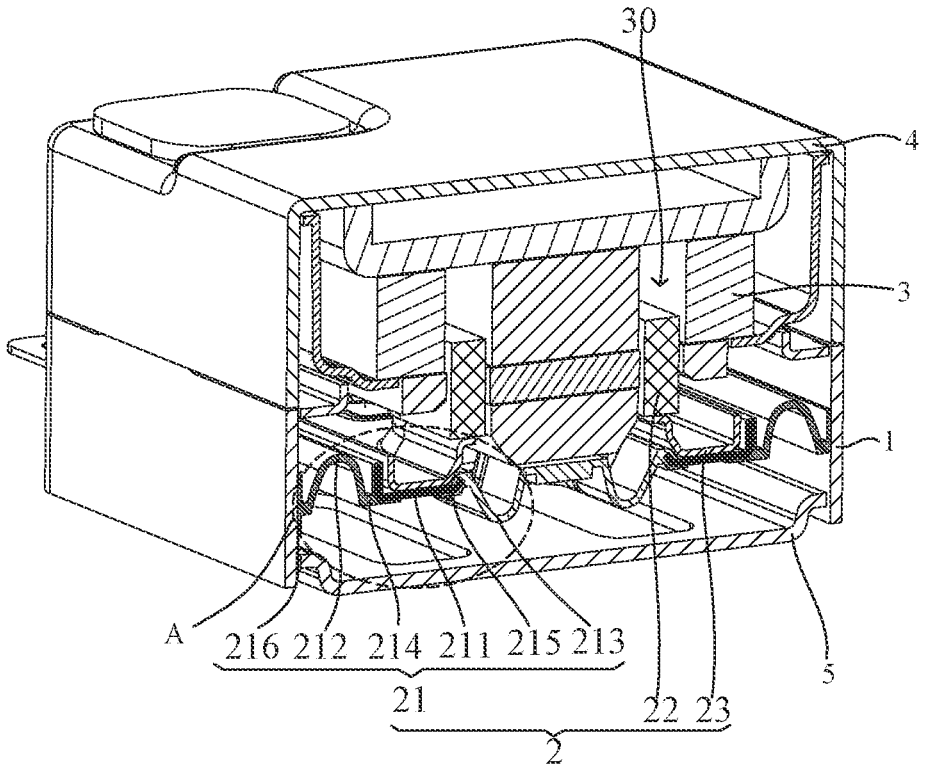
FIG. 2 is an illustrative cross-sectional view of the acoustic device taken along line II-II of FIG. 1.
Figure 3:
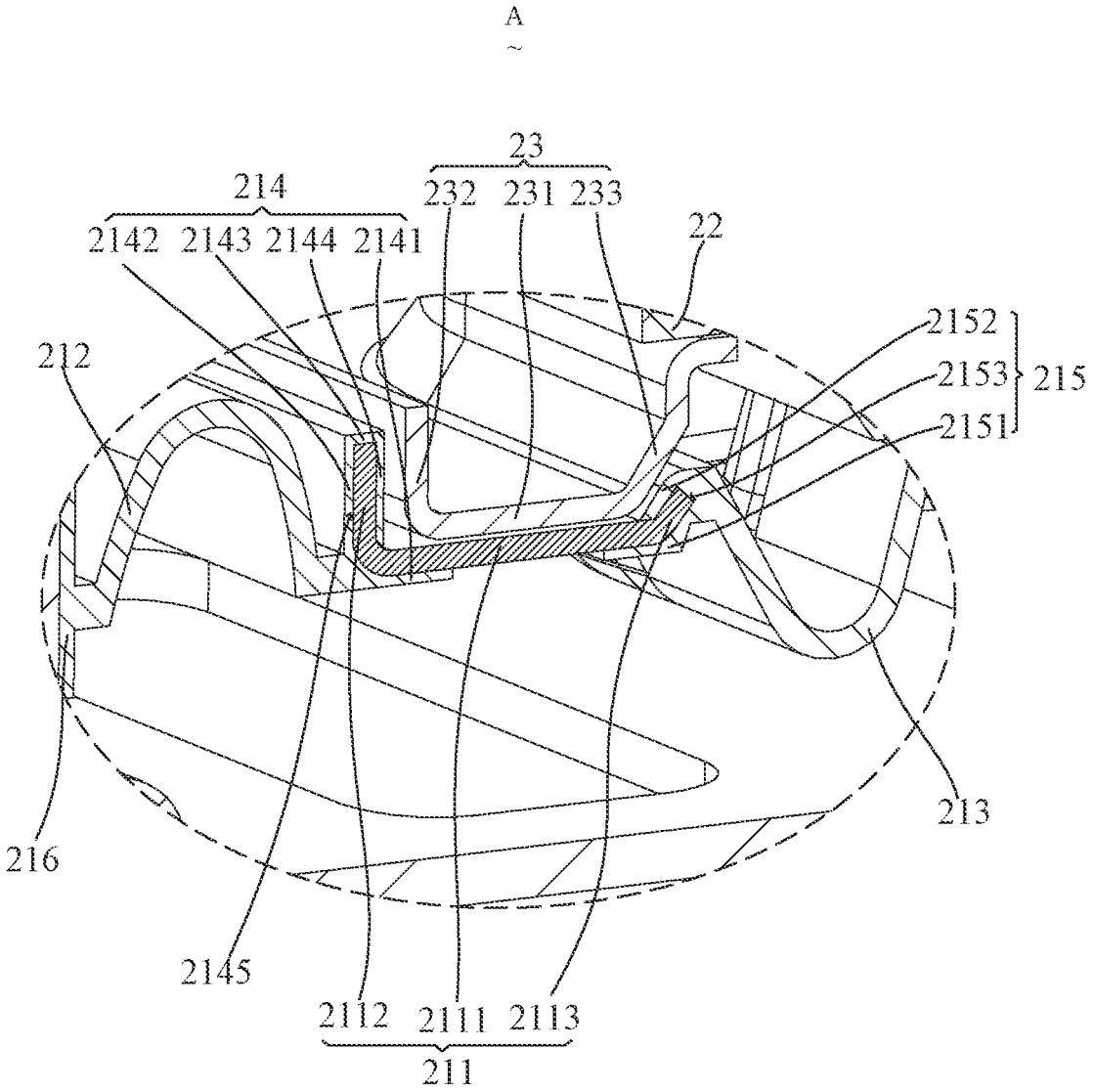
FIG. 3 is an enlarged view of the acoustic device of circled part A of FIG. 2.
Figure 4:
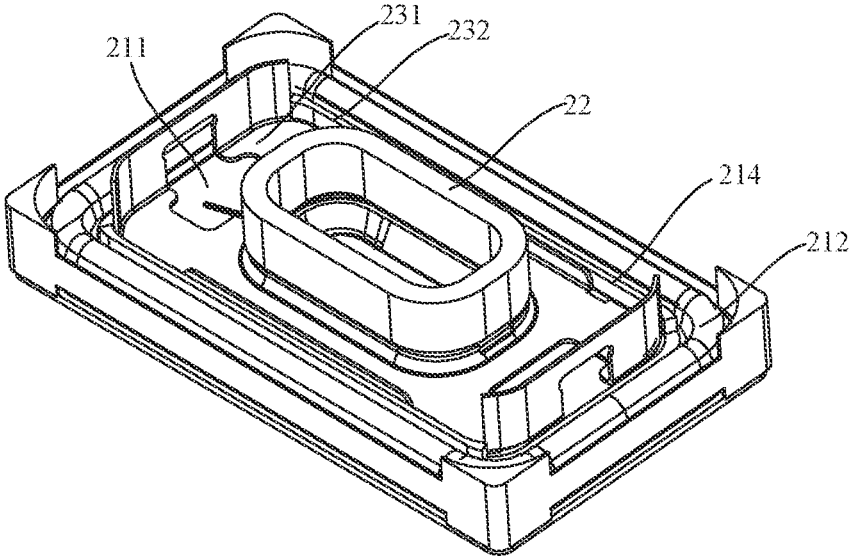
FIG. 4 is a partially isometric view of partly members of the acoustic device of the present invention.
Figure 5:
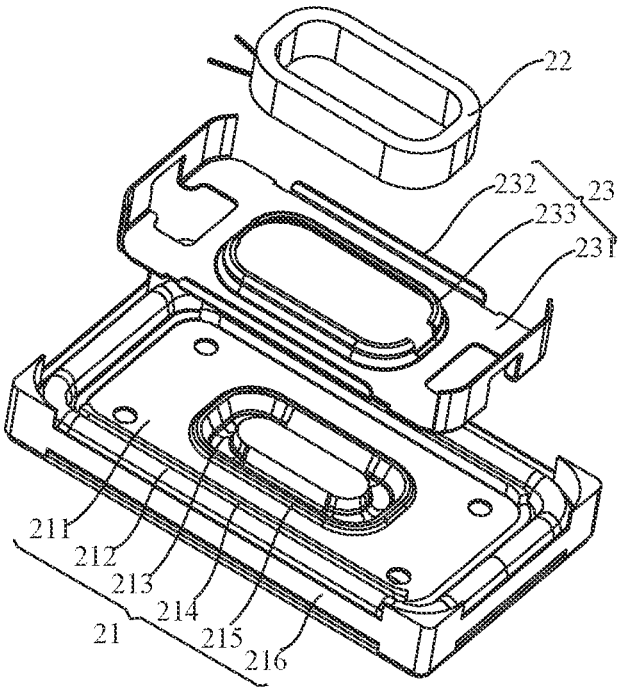
FIG. 5 is an exploded view of partly members of the acoustic device of FIG. 4.

Referring to the FIGS. 1-5, the present invention provides one embodiment of an acoustic device 100. The acoustic device 100 includes a frame 1, a vibration system 2, a magnetic circuit system 3 having a magnetic gap 30, a front cover 4 receiving the magnetic circuit system 3 and fixed to the frame 1, and a back cover 5 fixed on a side of the frame 1 distal to the front cover 4. The vibration system 2 is supported on the frame 1, and the magnetic circuit system 3 is supported on the front cover 4. The magnetic circuit system 3 drives the vibration system 2 to generate sounds.

In present embodiment, the vibration system 2 includes a diaphragm 21, a voice coil 22 at least partially located in the magnetic gap 30 and driving the diaphragm 21 to generate sounds, and a support 23 connecting with the diaphragm 21 and the voice coil 22.

The diaphragm 21 includes an annular dome 211, an annular first suspension 212, and an annular second suspension 213. The first suspension 212 surrounds and is arranged spaced apart from the second suspension 213. The dome 21 locates between and connecting to the first and second suspension. The diaphragm 21 further includes a first fixation portion 214 bending and extending from a side of the first suspension 212 proximal to the second suspension 213, a second fixation portion 214 bending and extending from a side of the second suspension 213 closed to the first suspension 212, and a third fixation portion 216 bending and extending from a side of the first suspension 212 distal to the second suspension 213. The third fixation portion 216 is mounted to an inner peripheral of the frame 1. The dome 211 includes an annular dome body 2111 and a first dome extending wall 2112 bending and extending from the dome body 2111 along a direction toward the magnetic circuit system 3. The first fixation portion 214 connects to and wraps the first dome extending wall 2112.

Both of the first suspension 212 and the second suspension 213 are in arc-shaped structures, and each of the first suspension 212 and the second suspension 213 has a recess direction, and the two recess directions are in opposite directions. Specifically, the recess direction of the first suspension 212 is a direction proximal to the voice coil 22, and the recess direction of the second suspension 213 is a direction distal to the voice coil 22.

The support 23 comprises a support flat wall 231, a first support extending wall 232, and a second support extending wall 233. The support flat wall 231 is attached to a surface of the dome body 2111 proximal to the voice coil 22. The first support extending wall 232 bends and extends from a side of the support flat wall 231 proximal to the first suspension 212 along the direction toward the magnetic circuit system 3. The first support extending wall 232 is arranged spaced apart from and opposite to the first dome extending wall 2112. The second support extending wall 233 extends from a side of the support flat wall 231 proximal to the second suspension 213 along the direction toward the voice coil 22 and is fixed to the voice coil 22.

Furthermore, the first dome extending wall 2112 is formed by extending from the dome body 2111 along the vibration direction of the diaphragm 21, and the first support extending wall 232 is formed by extending from the side of the support flat wall 231 proximal to the first suspension 212 along the vibration direction.

And furthermore, in order to enhance the strength of the connection between the dome 211 and the first fixation portion 214, the first fixation portion 214 comprises a first holding wall 2141 bending and extending from a side of the first suspension 212 proximal to the second suspension 213, a first side wall 2142 bending and extending from a side of the first holding wall 2141 proximal to the first suspension 212 along a vibration direction toward the magnetic circuit system 3, a first top wall 2143 bending and extending from the first side wall 2142 along the direction away from the first suspension 212, and a second side wall 2144 bending and extending from the first top wall 2143 along the vibration direction away from the magnetic circuit system 3. The first side wall 2142, the first top wall 2143, and the second side wall 2144 cooperatively enclose a first receiving slot 2145 for accommodating the first dome extending wall 2112. An outer peripheral of the dome body 2111 is attached to a surface of the first holding wall 2141 proximal to the magnetic circuit system 3.

The first support extending wall 232 is arranged spaced apart from the second side wall 2144. In other words, the first support extending wall 232 is arranged spaced apart from the first dome extending wall 2112. A gap is existed between the first support extending wall 232 and the first dome extending wall 2112.

In present embodiment, the dome 211 comprises a second dome extending wall 2113 bending and extending from a side of the dome body 2111 distal to the first dome extending wall 2112 to the direction toward the magnetic circuit system 3. There may be a certain angle between the bending direction of the second dome extending wall 2113 and the vibrating direction of the diaphragm 21. That is, the second dome extending wall 2113 can extend not along the vibration direction. The second fixation portion 215 connects to and wraps the second dome extending wall 2113.

In detail, the second fixation portion 215 comprises a second holding wall 2151 and a third side wall 2152 bending and extending from a side of the second suspension 213 closed to the first suspension 212. The second holding portion 2151 is arranged spaced apart from the third side wall 2152 and cooperatively encloses a second receiving slot 2153 with the third side wall 2152. The second dome extending wall 2113 is received in the second receiving slot 2153. An inner peripheral of the dome body 2111 is attached to the surface of the second holding wall 2151 proximal to the voice coil. Therefore, the outer peripheral of the dome body 2111 is located on the first holding wall 2141, and the inner peripheral of the dome body 2111 is located on the second holding wall 2151, which not only can improve the reliability of the connection of the dome body 2111, the first fixation portion 214 and the second fixing portion 215, but also can enhance the strength of the connection position.

Comparing with the related art, in the acoustic device of present invention, the acoustic device includes a frame, a vibration system supported on the frame, a magnetic circuit system having a magnetic gap. The vibration system comprises a diaphragm, a voice coil at least partially located in the magnetic gap and driving the diaphragm to generate sounds, and a support connecting with the diaphragm and the voice coil. The diaphragm comprises an annular dome, an annular first suspension, and an annular second suspension, the first suspension surrounding and spaced apart from the second suspension. The dome locates between and connects with the first and second suspension. The diaphragm further comprises a first fixation portion bending and extending from a side of the first suspension proximal to the second suspension. The dome comprises an annular dome body and a first dome extending wall bending and extending from the dome body along a direction toward the magnetic circuit system. The first fixation portion connects to and wraps the first dome extending wall. Therefore, by setting the first dome extending wall of the dome extending toward the magnetic circuit system, it is beneficial to enhance the strength of the vibration system, and to a certain extent, it can to improve the impact of the split vibration on the performance, and it expands and improves the high frequency of the acoustic device.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. An acoustic device, comprising:
- a frame;
- a magnetic circuit system having a magnetic gap;
- a vibration system supported on the frame, the vibration system comprising:
  - a diaphragm comprising:
    - an annular dome comprising:
      - an annular dome body;
      - a first dome extending wall bending and extending from the dome body along a direction toward the magnetic circuit system;
    - an annular first suspension;
    - an annular second suspension, the first suspension surrounding and spaced apart from the second suspension, the dome located between and connecting with the first and second suspension;
    - a first fixation portion bending and extending from a side of the first suspension proximal to the second suspension, the first fixation portion connected to and wrapping the first dome extending wall;
- a voice coil at least partially received in the magnetic gap for driving the diaphragm to generate sounds;
- a support connecting with the diaphragm and the voice coil.

2. The acoustic device as described in claim 1, wherein the support comprises a support flat wall, a first support extending wall, and a second support extending wall, the support flat wall is attached to a surface of the dome body proximal to the voice coil, the first support extending wall bends and extends from a side of the support flat wall proximal to the first suspension along the direction toward the magnetic circuit system, the first support extending wall is arranged spaced apart from and opposite to the first dome extending wall, the second support extending wall extends from a side of the support flat wall proximal to the second suspension along the direction toward the voice coil and is fixed to the voice coil.

3. The acoustic device as described in claim 2, wherein the first fixation portion comprises a first holding wall bending and extending from a side of the first suspension proximal to the second suspension, a first side wall bending and extending from a side of the first holding wall proximal to the first suspension along a vibration direction toward the magnetic circuit system, a first top wall bending and extending from the first side wall along the direction away from the first suspension, and a second side wall bending and extending from the first top wall along the vibration direction away from the magnetic circuit system, the first side wall, the first top wall, and the second side wall cooperatively enclose a first receiving slot for accommodating the first dome extending wall, an outer peripheral of the dome body is attached to a surface of the first holding wall proximal to the magnetic circuit system.

4. The acoustic device as described in claim 3, wherein the first support extending wall is arranged spaced apart from the second side wall.

5. The acoustic device as described in claim 3, wherein the first dome extending wall is formed by extending from the dome body along the vibration direction of the diaphragm, the first support extending wall is formed by extending from the side of the support flat wall proximal to the first suspension along the vibration direction.

6. The acoustic device as described in claim 1, wherein the diaphragm further comprises a second fixation portion bending and extending from a side of the second suspension closed to the first suspension, the dome comprises a second dome extending wall bending and extending from a side of the dome body distal to the first dome extending wall to the direction toward the magnetic circuit system, the second fixation portion connects to and wraps the second dome extending wall.

7. The acoustic device as described in claim 6, wherein the second fixation portion comprises a second holding wall and a third side wall bending and extending from a side of the second suspension closed to the first suspension, the second holding portion is arranged spaced apart from the third side wall and cooperatively encloses a second receiving slot with the third side wall, the second dome extending wall is received in the second receiving slot, an inner peripheral of the dome body is attached to the surface of the second holding wall proximal to the voice coil.

8. The acoustic device as described in claim 1, wherein both of the first suspension and the second suspension are in arc-shaped structures, each of the first suspension and the second suspension has a recess direction, and the two recess directions are in opposite directions.

9. The acoustic device as described in claim 8, wherein the recess direction of the first suspension is a direction proximal to the voice coil, and the recess direction of the second suspension is a direction distal to the voice coil.

10. The acoustic device as described in claim 1, wherein the diaphragm further comprises a third fixation portion bending and extending from a side of the first suspension distal to the second suspension, the third fixation portion is mounted to an inner peripheral of the frame.

* * * * *